United States Patent [19]

Tataseo

[11] Patent Number: 4,643,274

[45] Date of Patent: Feb. 17, 1987

[54] LADDER STAND-OFF DEVICE WITH SAFETY HARNESS

[76] Inventor: Victor Tataseo, 8410 N. 31st Dr., Phoenix, Ariz. 85021

[21] Appl. No.: 884,497

[22] Filed: Jul. 11, 1986

[51] Int. Cl.[4] ..... E06C 5/36; E06C 7/18; E06C 7/48

[52] U.S. Cl. ..... 182/106; 182/129; 182/214

[58] Field of Search ..... 182/214, 106, 107, 129

[56] References Cited

U.S. PATENT DOCUMENTS

| | | | |
|---|---|---|---|
| 1,522,292 | 1/1925 | Enssle | 182/214 |
| 1,881,902 | 10/1932 | Osterdahl | 182/106 |
| 1,921,583 | 8/1933 | Reed | 182/106 |
| 2,203,445 | 6/1940 | Schwarz | 182/106 |
| 2,934,163 | 4/1960 | Ladewski | 182/214 |
| 3,710,894 | 1/1973 | O'Dell | 182/106 |
| 4,211,306 | 7/1980 | Brenner | 182/106 |
| 4,363,378 | 12/1982 | Williams | 182/214 |
| 4,425,984 | 1/1984 | Lachance | 182/106 |

*Primary Examiner*—Reinaldo P. Machado
*Attorney, Agent, or Firm*—Herbert E. Haynes, Jr.

[57] ABSTRACT

A ladder stand-off device for supporting the upper end of a ladder in spaced relationship with a wall against which the ladder is leaned. The stand-off device includes a wall engaging brace which is movable about a pivot axis that is transverse to the ladder for adjusting the spaced relationship between the ladder and the wall. The ladder stand-off device includes a safety harness for wrapped around supporting positioning around a user of the ladder.

20 Claims, 5 Drawing Figures

LADDER STAND-OFF DEVICE WITH SAFETY HARNESS

BACKGROUND OF THE INVENTION

1. Field of the Invention

This invention relates in general to ladders and more particularly to a ladder stand-off device for supporting and stabilizing a ladder in a leaning attitude against a vertical wall with the device also including a safety harness.

2. Description of the Prior Art

Ladders have been used for many years for performing work related tasks at heights otherwise not reachable.

Despite the wide use of ladders, however, a significant number accidents occur each year which are related to ladder use. Of course, some of these accidents result from the negligence of the individual using the ladder, and other accidents can perhaps be traced to faulty ladder design or construction. However, there are several situations in which the use of a ladder remains awkward and/or dangerous in spite of the fact that the ladder is well-designed and constructed and that the user is reasonably careful during its use.

One such situation arises when it is necessary to work at or near the top of a ladder which is leaning against a vertical support. For example, when working on the outside of a house, the edges of the roof generally hang over the outside vertical walls, thereby making it awkward to work near the top of a ladder which lies directly below the roof. Working under the other types of overhangs may similarly make ladder work difficult. Unfortunately, in such a situation the user often finds himself standing very close to the top of the ladder with nothing to hang onto. He may also be required to attempt some awkward and dangerous reaching in order to accomplish his desired objective. These factors, of course, may contribute significantly to the danger of ladder use.

Another common situation in which proper ladder use may be awkward arises when a ladder must be used adjacent windows and shrubs. As a general rule, the base of a ladder should be positioned one foot away from the ladder's vertical supporting surface for every four feet of ladder length. However, when working adjacent windows and shrubs, it is frequently difficult to maintain this proper slope. Often, for example, if the ladder were to be positioned properly, the top of the ladder would rest against a window; consequently, in order to avoid damaging the window, the ladder user either positions the top of the ladder just below or above the window. Thus, the user may find that the ladder is improperly positioned to support him. Similar problems may arise when a ladder must be used adjacent shrubs, since the proper positioning of the base of the ladder may be impossible.

A further situation which may make ladder use awkward or dangerous occurs when a ladder must be used adjacent an uneven vertical surface. Occasionally, an individual will simply place a ladder against an uneven surface and then attempt to climb the ladder, even though only one of the ladder's side rails is actually in contact with the vertical supporting surface. It will be readily appreciated that this situation creates a substantial danger, and a ladder so positioned will frequently twist away from the supporting surface and fall.

In order to minimize the awkwardness and danger involved in the above-mentioned situations, those skilled in the art have commonly used a device called a wall stand-off. A typical prior art stand-off comprises two support arms which are connected to the side rails so that the top of the ladder is spaced outwardly from the vertical surface. By using this sort of device, one may easily work adjacent the top of the ladder while still having sufficient room to hang onto the top of the ladder's side rails. Additionally, since the ladder is supported a predetermined distance from the supporting wall, awkward and dangerous reaching can be minimized. It will further be appreciated that prior art stand-off devices of this sort can be positioned such that the proper ladder slope is maintained when the ladder is used adjacent windows or shrubs.

However, in spite of the advantages of the prior art type of wall stand-off devices, there are several disadvantages associated with its use. First, it will be appreciated that since the stand-off attached to the side rails of the ladder, the stand-off is somewhat inconvenient to remove. Significantly, a worker often finds himself without the correct tools to remove the stand-off device. Consequently, when using a ladder to which a stand-off has been attached, a worker may try to use the ladder without removing the stand-off. There are numerous situations in which the use of a stand-off would not be appropriate and would tend to increase the danger of ladder usage.

Although the above discussed prior art stand-off devices provide a significant work and safety advantages over conventional ladders, they can still be dangerous. Due to the stand-off capability, there is an increased tendency for a user to place the ladder in a severely upright position, and this results in an increase in the chances for a user to lose his balance and fall backward.

Therefore a need exists for a new and improved ladder stand-off device with a safety harness which overcomes some of the problems and shortcomings of the prior art.

SUMMARY OF THE INVENTION

In accordance with the present invention, a new and improved ladder stand-off device with safety harness is disclosed.

The improved stand-off devices includes a pair of plates each of which is for attachment to a different one of the vertical side rails of a ladder. A substantially U-shaped wall brace has a pair of arms which are pivotably attached to the plates and has a bight portion for placement in bearing engagement with the vertical wall against which the ladder is to be leaned. The plates are each provided with a semi-circular array of aligned holes and each of the arms of the wall brace have a hole therein. A suitable pull pin is demountably carried in the holes of the arms of the wall brace and is selectively passed through an aligned pair of the holes provided in the plates. In this way, the angular extending attitude of the wall brace relative to the ladder can be adjusted to suit the amount of desired ladder stand-off. This also allows the wall brace to be placed so that it depends from the plate in substantially parallel relationship with the ladder so that the stand-off is out of the way in situations where it is not desirable to use it. Also, the wall brace can be positioned so that it extends upwardly from the plates in substantially parallel relationship with respect to the ladder so that the wall brace will act as an extension of the ladder.

The bight portion of the wall brace can be used directly for wall engaging purposes, or elongated wall engaging members can be selectively attached thereto to increase stability and span window openings and the like. Also, when the wall brace is disposed in a substantially horizontal attitude, a tool tray may be demountably supported between the arms thereof.

As mentioned above, the wall brace portion of the improved stand-off device is pivotably connected to the two ladder mounted plates. A safety harness is also pivotably attached to the plates so as to extend in an opposite direction from the ladder and the same pivot attachment hardware is preferably used to facilitate use of the device of the present invention. The safety harness is similar to the wall brace in that it is of substantially U-shaped configuration with the bight portion being preferably curved so that it loops around the user of the ladder. The safety harness is limited as to its pivotable movement in a downward direction by means of stops provided on the two plates. The stops are located so that they prevent the harness from falling, or being moved into, a depending attitude relative to the pivot axis. In this manner, the safety harness is kept from being moved into a wrapped around position relative to the user's lower body portions, such as behind his knees, and thus will support the user's upper body portions rather than tripping him in the event that he loses his balance.

Accordingly, it is an object of the present invention to provide a new and improved ladder stand-off device with a safety harness.

Another object of the present invention is to provide a new and improved ladder stand-off device with a safety harness, the stand-off device including a wall engaging brace which is pivotably movable into selected angular attitudes relative to the ladder for adjustably setting the amount of upper ladder stand-off relative to the vertical wall against which it is to be leaned.

Another object of the present invention is to provide a new and useful device of the above described character wherein the wall engaging brace may be pivotably moved into a depending attitude in substantially parallel relationship with respect to the ladder so that the stand-off device is completely out of the way when not in use. Another object of the present invention is to provide a new and useful device of the above described character wherein the wall engaging brace may be pivotably moved into an upstanding attitude in substantially parallel relationship with respect to the ladder to provide an extension of the ladder.

Another object of the present invention is to provide a new and useful ladder stand-off device of the above described character wherein the safety harness portion thereof extends from the ladder in a direction opposite to the wall engaging brace for looped around placement about a user of the ladder.

Another object of the present invention is to provide a new and useful ladder stand-off device with safety harness of the above described type and further including stop means for limiting the downward movement of the safety harness to kepp it in a wrapped around position proximate the upper body portions of a user.

The foregoing and other objects of the present invention as well as the invention itself, may be more fully understood from the following description when read in conjunction with the accompanying drawings.

DESCRIPTION OF THE PREFERRED EMBODIMENT

Figure 1:
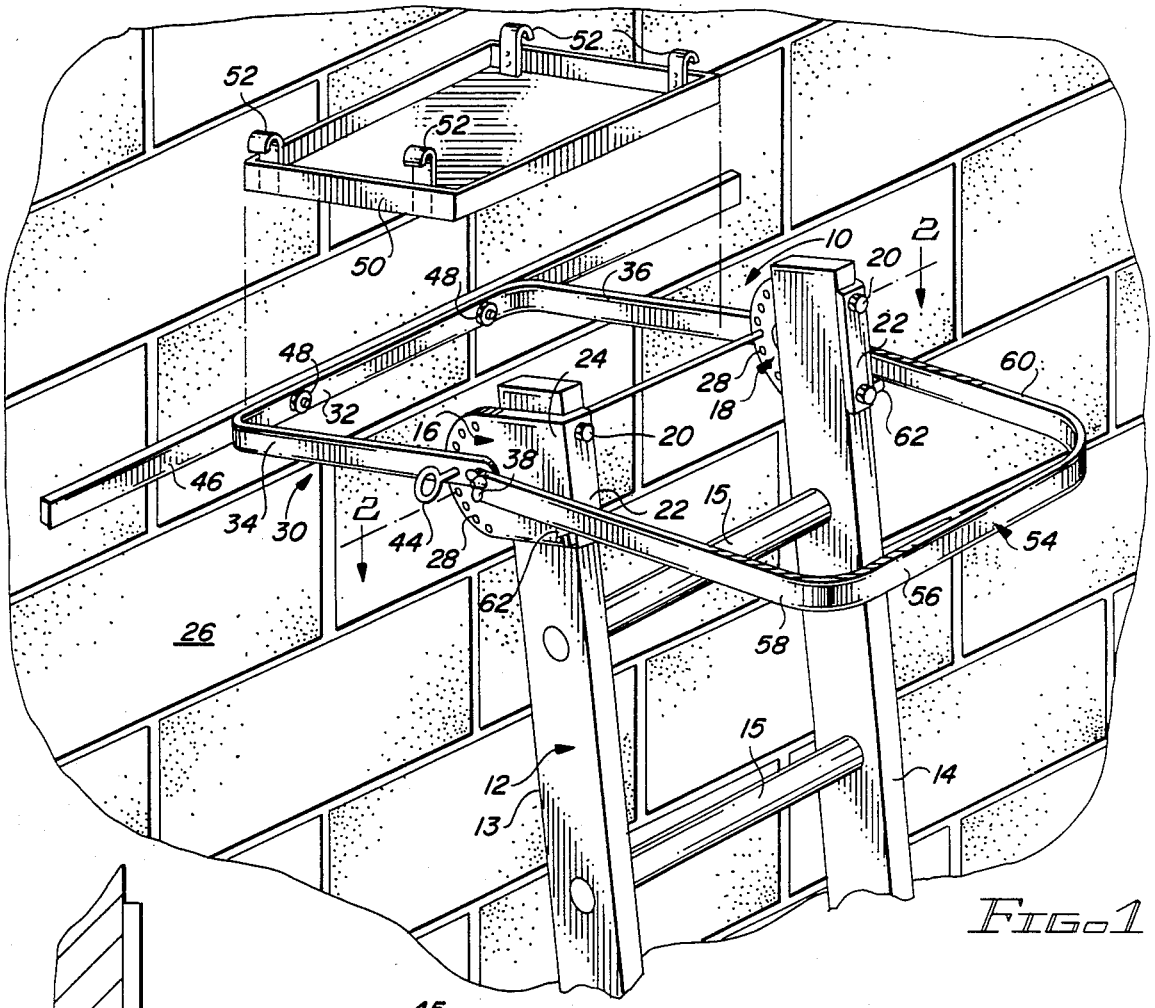
FIG. 1 is a fragmentary perspective view of the upper end of a typical extension ladder with the ladder stand-off device and safety harness of the present invention mounted thereon, and illustrating a portion thereof as being in exploded relationship therewith.
Figure 2:
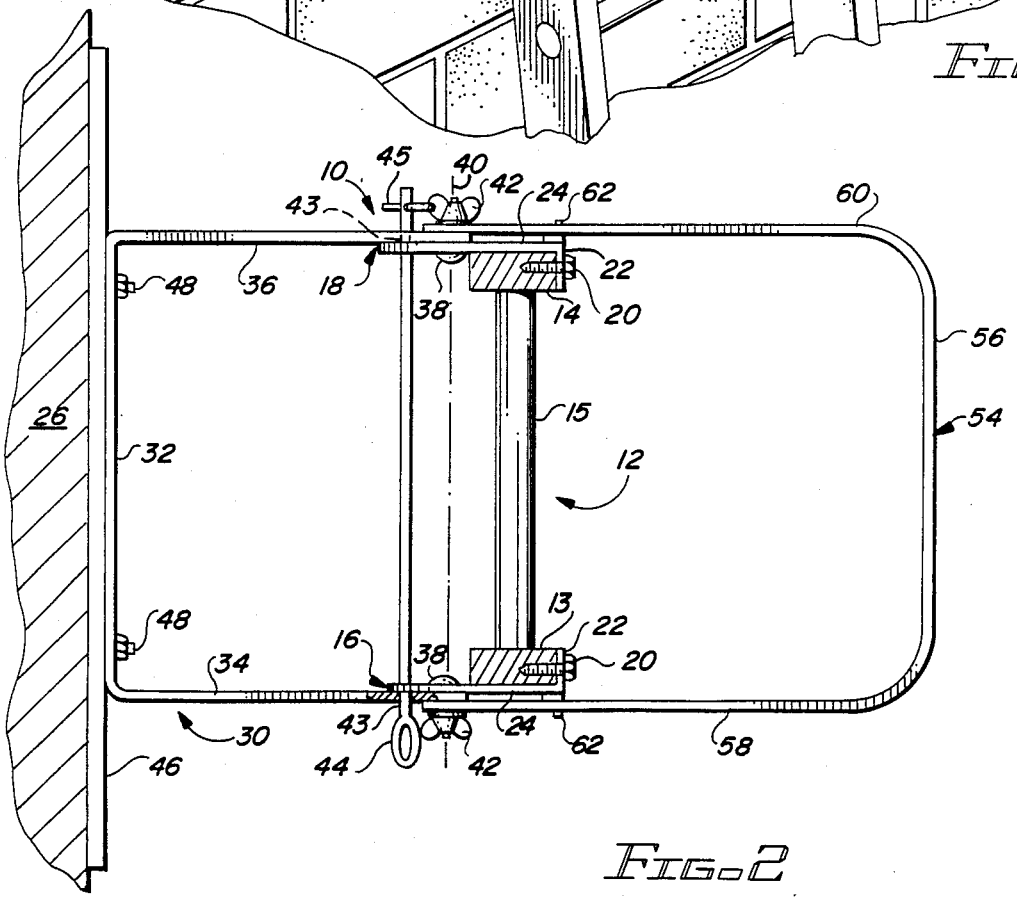
FIG. 2 is a sectional view taken along the line 2—2 of FIG. 1.

Referring more particularly to the drawings, FIG. 1 shows the ladder stand-off device with safety harness of the present invention, which is indicated generally by the reference numeral 10, as being mounted on the upper end of a typical ladder 12.

The ladder 12 is the type formed of wood and includes a spaced apart pair of side rails 13 and 14 which are interconnected by plurality of spaced apart rungs 15.

The ladder stand-off device with safety harness 10 includes a pair of plates 16 and 18 which are mirror images of each other and are attached to the ladder's side rails 13 and 14 respectively by suitable fasteners 20 such as the illustrated lag bolts. Each of the plates 16 and 18 is formed with a right angle end flange 22 through which the bolts 20 pass, and a planar portion 24 which lies in the same plane as the outwardly disposed surface of its respective one of the ladder's side rails 13 and 14 and extends therefrom toward the wall 26 against which the ladder 12 is to be leaned. The extending ends of the plates are preferably arcuate and a semi-circular array of spaced apart holes 28 are formed through the plates proximate their arcuate extending edges.

A wall engaging brace 30 of substantially U-shaped configuration is provided with a bight portion 32 having a pair of arms 34 and 36 extending from the opposite ends of the bight portion 32. The distal ends of the arms 34 and 36 are carried on bolt-type studs 38 which are carried in the plates 16 and 18. The studs are in alignment with each other and define a pivot axis 40 which is transverse of the ladder 12 and about which the wall engaging brace is pivotably movable. Suitable wing nuts 42 are threadingly carried on the studs to prevent the arms from moving axially off of the studs and for tightening purposes as will hereinafter be discussed in more detail.

The arms 34 and 36 are also provided with suitable holes 43 proximate their distal ends which overlay and align with the semi-circular array of holes 28 formed in the plates 16 and 18. An elongated pull pin 44 is passed through the holes 43 of the arms 34 and 36 and through a selected aligned pair of the plurality of holes 28 of the plates for adjustably setting the angular extension of the wall engaging brace 30 relative to the ladder 12, and the pull pin is secured against displacement by a suitable lock pin 46. In this manner, a user can pre-select the stand-off distance between the upper end of the ladder 12 and the wall 26 against which it is to be leaned.

If desired, the bight portion 32 of the wall engaging brace 30 may be placed in direct wall bearing engagement. However, it is preferred that an elongated wall engaging member 46 formed of wood or the like, be demountably carried, such as by means of the illustrated fasteners 48 on the bight portion 32 of the wall brace so as to be interposed between the wall brace 30 and the wall 26. The wall engaging member 46 may be of any desired length and when it is longer than the length of the bight portion 32 of the wall engaging member 30, it will provide improved ladder stability. Also, the wall engaging member 46 can be selected so as to span a window (not shown) or other opening formed in a wall against which the ladder 12 is to be traced.

When the wall engaging brace 30 is adjusted so that it lies in a substantially horizontal attitude, a tool tray 50 may be demountably supported, such as by means of the illustrated hooks 52, between the arms of the brace 30 as indicated in FIG. 1. The tool tray 50 may be used for holding various tools, such as hammers, nails, painting equipment and supplies, and the like.

Figure 3:
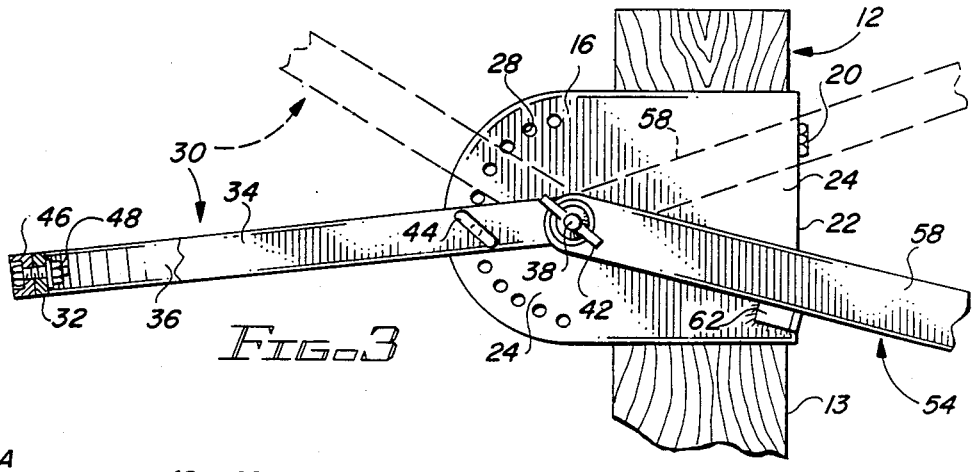
FIG. 3 is an enlarged fragmentary side elevational view of the device with a portion thereof being broken away to show the one of the various features thereof.

The safety harness portion of the device of the present invention is a substantially U-shaped strap 54 which is mounted so as to extend from the ladder 12 in a direction which is opposite to the extending direction of the wall engaging brace 30. The safety strap 54 is preferably formed of metal and has a bight portion 56 which may be curved slightly along its length for looped around placement about a user of the ladder 12. A pair of arms 58 and 60 each extend from a different end of the bight portion 56 and the arms are pivotably attached at their ends to the plates 16 and 18 of the stand-off device 10. The arms 58 and 60 are preferably pivotably attached to the plates 16 and 18 by the previously described studs 38. Such pivotable mounting of the safety harness strap 54 allows it to be moved to a conformable and proper user supporting position and when in the desired position, it is held by tightening of the wing nuts 42 that are threadingly carried on the studs 38. As seen best in FIGS. 1 and 3, each of the plates 16 and 18 are provided with a stop lug 62 which prevents the safety harness strap 54 from falling, or being imprudently adjusted, into a downwardly sloping attitude where it would wrap about the lower body portion of a user and thus not properly support him in the event that he should lose his balance. In otherwords, to properly support a user, the safety harness strap 54 should wrap around the user proximate his waist and not be allowed to fall behind the user's knees.

Figure 4:
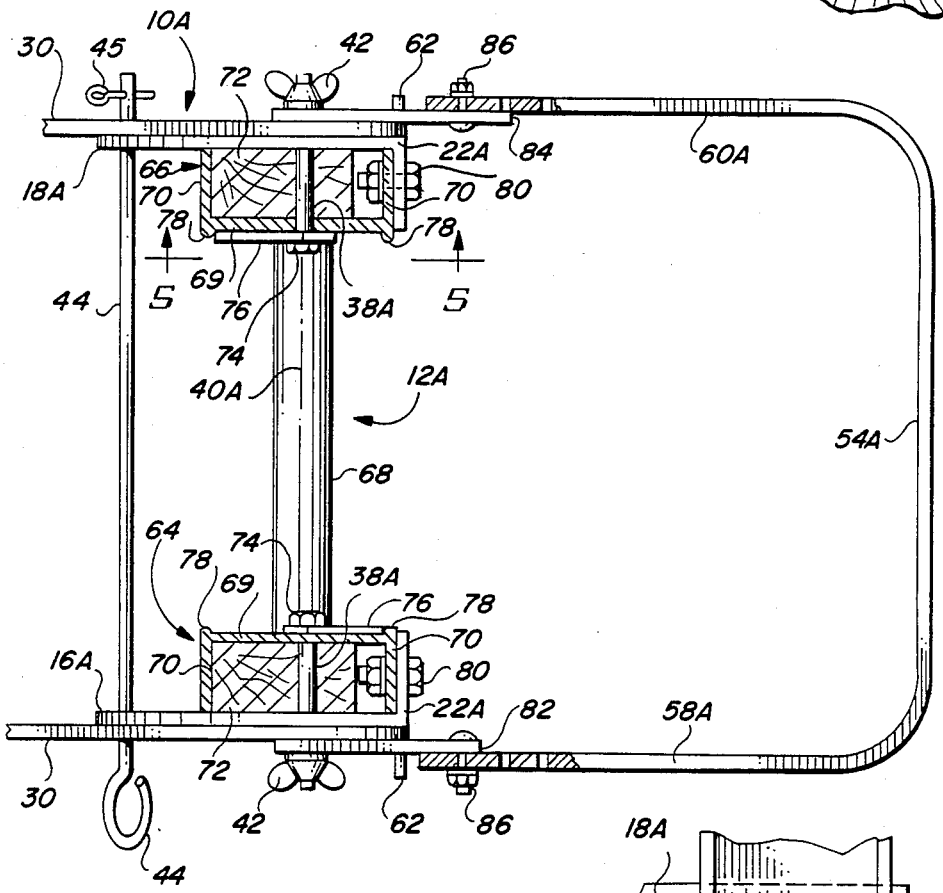
FIG. 4 is a sectional view similar to FIG. 2 but showing the ladder stand-off device with safety harness as being mounted on a different type of ladder.
Figure 5:
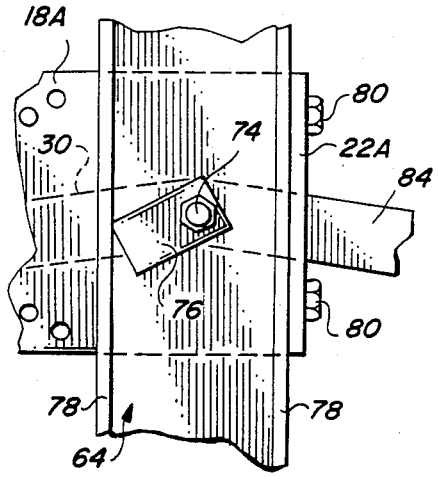
FIG. 5 is an enlarged fragmentary sectional view taken along the line 5—5 of FIG. 4.

The ladder stand-off device with safety harness 10 described above is adapted for mounting on the wooden ladder 12 as shown. The ladder stand-off device with safety strap shown in FIGS. 4 and 5 and indicated generally by the reference numeral 10A, is essentially the same but is modified slightly to better suit its being mounted on a metal ladder 12A of the type which is well known in the art.

The metal ladder 12A is provided with elongated metal side rails 64 and 66, such as of extruded aluminum, and interconnecting metallic tubular rungs 68 (one shown). As shown, the side rails 64 and 66 are typically of substantially U-shaped cross sectional configuration having their bight portions 69 facing each other on what may be described as the inwardly facing sides of the rails, and the spaced apart flanges 70 of the rails extend outwardly from the opposed edges of their respective bight portions 69. For this reason, spacer blocks 72, such as of wood are located in the outwardly opening channel defined by each of the metal side rails 64 and 66 to provide supportive bearing surfaces for the mounting plates 16A and 18A of the device 10A.

The mounting plates 16A and 18A of the device 10A are similar to the above fully described plates 16 and 18 except that the bolt-type studs 38A which define the pivot axis 40A are located so that they pass through the bight portions 69 of their respective rails 64 and 66 and through the spacer blocks 72 to hold them in place. The studs 38A have heads 74 to which tabs 76 are affixed, such as by welding. The tabs 76 rotate axially with the studs 38A until they come into bearing engagement with the protruding ridges 78 which are formed along the longitudinal edges of the bight portions of the rails 64 and 66 so as to extend normally from the outwardly facing surfaces thereof. In this manner, the studs 38A can be removed and replaced for mounting and removal of the device 10A from the ladder 12A but can be tightened by manual manipulation of the wing nuts 42 without the use of tools.

In addition to the plates 16A and 18A being mounted on the ladder 12A by the studs 38A, suitable bolts 80 are used to attach the right angle flanges 22A of the plates to the rails 64 and 66.

Otherwise the plates 16A and 18A are identical to the hereinbefore described plates 16 and 18 and the wall engaging brace 30 of this modified device 10A is the same as that described above as is the pull pin 44 which is used to secure the wall engaging brace 30 in the desired extending position.

A modified safety harness 54A is shown as being used in this embodiment of the present invention with it being understood that the previously described safety harness 54 could be used. The safety harness 54A is essentially the same except that extension members 82 and 84 are adjustably carried on the extending ends of the arms 58A and 60A by suitable bolts 86, to allow the harness strap 54A to be adjusted to suit different size people.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A ladder stand-off device with a safety harness for use with a ladder having a spaced apart pair of side rails, said ladder stand-off device with a safety harness comprising:

(a) a pair of mounting plates for attachment to different ones of the side rails of the ladder and including means defining a pivot axis which is disposed transversely of the ladder;

(b) a wall engaging brace extending from said pair of mounting plates, said brace being pivotably movable about the pivot axis defined by said pair of mounting plates for movement into a desired angularly extending position relative to one side of the ladder;

(c) means for locking said wall engaging brace in a selected angularly extending position; and (d) safety harness means connected to said pair of mounting plates so as to extend therefrom in a direction substantially opposite to said wall engaging brace for placement about the body of a user of the ladder.

2. A ladder stand-off device with a safety harness as claimed in claim 1 wherein said safety harness means includes a strap of substantially U-shaped configuration defining a bight portion and a pair of arms, said pair of arms each having a distal end which is attached to a different one of said pair of mounting plates.

3. A ladder stand-off device with safety harness as claimed in claim 1 wherein said safety harness means includes a strap of substantially U-shaped configuration defining a bight portion and a pair of arms, said pair of arms each having a distal end which is attached to a different one of said pair of mounting plates for pivotable movement of said strap about the pivot axis defined by said pair of mounting plates.

4. A ladder stand-off device with safety harness as claimed in claim 3 and further including stop means on each of said pair of mounting plates for limiting the pivotable movement of said strap to prevent its moving beyond a position of extending substantially normally from the ladder toward the bottom end of the ladder.

5. A ladder stand-off device with safety harness as claimed in claim 4 and further comprising means for releasably holding said strap in a selected position of pivotably movement about the pivot axis defined by said pair of mounting plates.

6. A ladder stand-off device with safety harness as claimed in claim 5 and further comprising:

(a) a pair of threaded studs each mounted on a different one of said pair of mounting plates for defining the pivot axis thereof;

(b) each of said pair of arms of said strap having a hole formed proximate its distal end through which a different one of said pair of studs passes loosely; and (c) nut means carried on each of said pair of threaded studs to provide said means for releasably holding said strap.

7. A ladder stand-off device as claimed in claim 1 wherein said wall engaging brace is of substantially U-shaped configuration defining a bight portion with a pair of arms each extending from a different one of the opposite ends of said bight portion, each of said pair of arms having a distal end which is attached to a different one of said pair of mounting plates for pivotable movement of said wall engaging brace about the pivot axis defined by said pair of mounting plates.

8. A ladder stand-off device as claimed in claim 7 wherein said bight portion is of linear configuration for bearing against a wall when the ladder is placed in leaning engagement therewith.

9. A ladder stand-off device as claimed in claim 7 and further comprising an elongated wall engaging member demountably attached to said bight portion of said wall engaging brace.

10. A ladder stand-off device as claimed in claim 7 and further comprising a tool tray demountably carried between said pair of arms of said wall engaging brace.

11. A ladder structure with a stand-off device and safety harness comprising in combination:

(a) a ladder having elongated side rails and upper and lower ends;

(b) a pair of mounting plates each attached to a different one of the side rails of said ladder proximate the upper end thereof, said pair of mounting plates including means defining a pivot axis which is disposed transversely of said ladder;

(c) a wall engaging brace extending from said pair of mounting plates, said brace pivotably movable about the pivot axis defined by said pair of mounting for movement into a desired angularly extending position relative to one side of said ladder;

(d) means for locking said wall engaging brace in a selected angularly extending position; and (e) safety harness means connected to said pair of mounting plates so as to extend therefrom in a direction which is substantially opposite to said wall engaging brace for placement about the body of a user of said ladder.

12. A ladder structure as claimed in claim 11 wherein said safety harness means includes a strap of substantially U-shaped configuration defining a bight portion and a pair of arms, each of said arms having a distal end which is attached to a different one of said pair of mounting plates.

13. A ladder structure as claimed in claim 11 wherein said safety harness means includes a strap of substantially U-shaped configuration defining a bight portion and a pair of arms, said pair of arms each having a distal end which is attached to a different one of said pair of mounting plates for pivotable movement of said strap about the pivot axis defined by said pair of mounting plates.

14. A ladder structure as claimed in claim 13 and further comprising stop means on each of said pair of mounting plates for limiting the pivotable movement of said strap to movement between a substantially normally extending position relative to said ladder and a position wherein said strap extends from said pair of mounting plates toward the upper end of said ladder.

15. A ladder structure as claimed in claim 14 and further comprising means for releasably holding said strap in a selected position of pivotable movement about the pivot axis defined by said pair of mounting plates.

16. A ladder structure as claimed in claim 15 and further comprising:

(a) a pair of threaded studs each mounted on a different one of said pair of mounting plates for defining the pivot axis thereof;

(b) each of said pair of arms of said strap having a hole formed proximate its distal end through which a different one of said pair of studs passes loosely; and (c) nut means carried on each of said pair of threaded studs to provide said means for releasably holding said strap.

17. A ladder structure as claimed in claim 11 wherein said wall engaging brace is of substantially U-shaped configuration defining a bight portion with a pair of arms each extending from a different one of the opposite ends of said bight portion, each of said pair of arms having a distal end which is attached to a different one of said pair of mounting plates for pivotable movement of said wall engaging brace about the pivot axis defined by said pair of mounting plates.

18. A ladder structure as claimed in claim 17 wherein said bight portion of said wall engaging brace is of linear configuration for bearing engagement with a wall when said ladder is placed in leaning engagement therewith.

19. A ladder structure as claimed in claim 17 and further comprising an elongated wall engaging member demountably attached to said bight portion of said wall engaging brace.

20. A ladder structure as claimed in claim 17 and further comprising a tool tray demountably carried between said pair of arms of said wall engaging brace.

* * * * *